United States Patent [19]

Burton et al.

[11] Patent Number: 4,821,509

[45] Date of Patent: Apr. 18, 1989

[54] PULSED ELECTROTHERMAL THRUSTER

[75] Inventors: Rodney L. Burton, Fairfax Station, Va.; Yeshayahu S. A. Goldstein, Gaithersburg; Derek A. Tidman, Silver Spring, both of Md.; Niels K. Winsor, Alexandria, Va.

[73] Assignee: GT-Devices, Alexandria, Va.

[21] Appl. No.: 133,154

[22] Filed: Dec. 7, 1987

Related U.S. Application Data

[62] Division of Ser. No. 743,150, Jun. 10, 1985.

[51] Int. Cl.[4] ..... F03H 1/00

[52] U.S. Cl. ..... 60/203.1; 60/204

[58] Field of Search ..... 60/202, 203.1, 265, 60/204; 313/231.41, 231.31, 362.1; 219/121 PN, 121 PQ, 121 PR, 121 PU

[56] References Cited

U.S. PATENT DOCUMENTS

| | | | |
|---|---|---|---|
| 3,020,431 | 2/1962 | Martina | 60/202 |
| 3,221,212 | 11/1965 | Gorowitz et al. | 60/202 |
| 3,233,404 | 2/1966 | Huber et al. | 60/202 |
| 3,239,130 | 3/1966 | Naundorf, Jr. | 60/202 |
| 3,353,061 | 11/1967 | Davis | 60/202 |
| 3,360,682 | 12/1967 | Moore | 60/202 |
| 3,545,208 | 12/1970 | Stark et al. | 60/202 |
| 3,603,089 | 9/1971 | Esker | 60/203.1 |
| 4,577,461 | 3/1986 | Cann | 60/203.1 |

OTHER PUBLICATIONS

Barrere et al., *Rocket Propulsion,* Elsevier Pub., Co., 3/1960, p. 462.

*Primary Examiner*—Donald E. Stout

*Attorney, Agent, or Firm*—Lowe, Price, Leblanc, Becker & Shur

[57] ABSTRACT

A plasma electrothermal thruster includes a capillary passage in which a plasma discharge is formed and directed out of an open end of the passage into a supersonic nozzle. Liquid supplied to the capillary passage becomes partially atomized to cool a confining surface of the passage. The plasma discharge is formed as the atomized liquid flows out of the open end into a supersonic equilibrium nozzle. The discharge can have a duration greater than the two way travel time of acoustic energy in the capillary to cause the plasma to flow continuously through the nozzle during the time of the discharge pulse.

9 Claims, 5 Drawing Sheets

Fig. 3
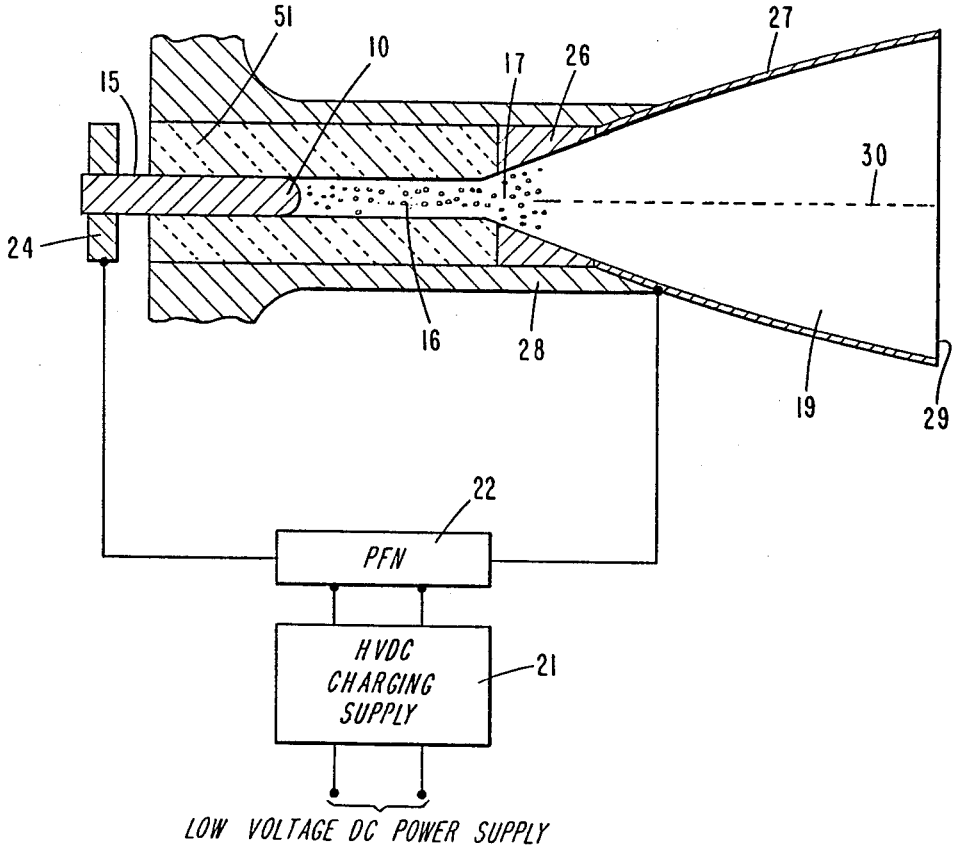
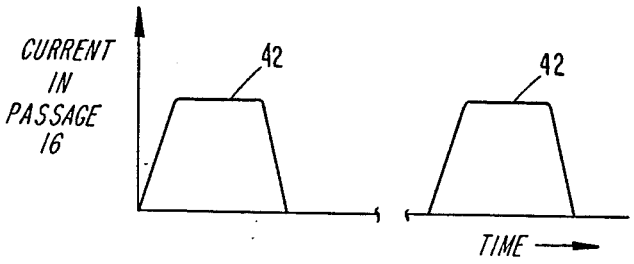
Fig. 3a

PULSED ELECTROTHERMAL THRUSTER

The invention was made with Government support under contract NAS3-23779 awarded by NASA. The Government has certain rights in this invention.

This is a division of application Ser. No. 743,150, filed June 10, 1985.

TECHNICAL FIELD

The present invention relates generally to plasma thrusters and more particularly to a plasma electrothermal thruster including a capillary passage from which a high velocity, high pressure plasma is emitted to propel a mass.

BACKGROUND ART

The use of directed plasmas as a thruster for accelerating a mass on which the plasma source is located has been previously suggested. In Mastrup, U.S. Pat. No. 3,447,322, is disclosed a pulsed ablating thruster apparatus wherein an electric discharge is established in a passageway having one end terminated in a nozzle. The passageway is a bore of an ablating thruster body formed of material such as Plexiglass, nylon and Teflon. In response to a discharge voltage being established between opposite ends of the passage, material is ablated from a confining wall of the passage. The ablated material flows out of the nozzle to provide an accelerating force for the mass on which the thruster is located. Mastrup indicates that the pressure in the passage is to be maintained below 200 atmospheres.

There are numerous problems associated with the thruster disclosed in the Mastrup patent. In particular, ablating the types of materials specifically mentioned in the patent results in a relatively low thrust efficiency of about 20%. This is because of the low pressure of less than 200 atmospheres, which causes the gaseous materials which are formed by the ablation process in response to the discharge voltage to be emitted in a highly ionized and dissociated state. In addition, the confining surface, i.e., wall, of the ablated passage becomes excessively hot if attempts are made to activate the thruster repetitively to generate high thrust, i.e., the product of mass flow rate and velocity. Also, the maximum pressure of 200 atmospheres is insufficient to obtain high thrust in a small, compact device.

A further electric thruster, disclosed in LaRocca, U.S. Pat. No. 3,575,003, includes a wax-like working substance for electrically powering thrust engines by prolonged heating in a vacuum of liquid or soft grease made of fluorocarbon polymers. The resulting material flows under surface tension through tapered passages, moving slowly in a wax-like condition. When heated, the substance moves more rapidly and becomes more fluid. The substance ablates in response to the electric energy and flows out of a central cylindrical or conical aperture to provide propulsive forces to a mass on which the thruster is located. The thrust and efficiency which can be achieved with the structure of the LaRocca device are insufficient for many purposes to achieve any substantial payload velocity.

In the copending, commonly assigned applications of Goldstein et al, Ser. No. 471,215, filed Mar. 1, 1983, and Goldstein et al, Ser. No. 657,888, filed Oct. 5, 1984, are disclosed plasma propulsive systems wherein a projectile is accelerated in response to a plasma discharge established in a capillary passage. A discharge voltage is established between opposite ends of the passage to cause a plasma to be directed out of one end of the passage. The plasma acts on a projectile, to accelerate the projectile in the direction of plasma flow. In the invention of Ser. No. 471,215, the plasma is directed into a barrel through which the projectile is accelerated by a number of capillaries that are offset with respect to the barrel. In the invention of Ser. No. 657,888, the capillary passage and barrel are aligned. To reduce heating of the barrel, a fluent material, such as water, is located immediately downstream of the capillary passage. The fluent material mixes with the plasma ejected from the capillary passage to reduce the plasma temperature and prevent substantial ablation of the barrel.

The apparatus and method disclosed in the inventions of Ser. Nos. 471,215 and 657,888 are particularly advantageous because of the high plasma momentmm obtained each time a plasma jet is derived from the capillary passage. The high momentum occurs because of the very efficient transfer of energy from an electric power supply to the low molecular weight material used to form the plasma.

In one preferred embodiment in the inventions of Ser. Nos. 471,215 and 657,888, the plasma is formed by ablating hydrogen and carbon atoms from a wall of a polyethylene sleeve having an interior bore that forms the capillary passage. The low atomic weight of the carbon and hydrogen, as well as the electrical characteristics of the capillary passage and the flow characteristics of the passage, provides a highly efficient transfer of electrical energy into plasma kinetic energy.

We have found through experimentation that with appropriate modification structures of the type disclosed in the inventions of Ser. Nos. 471,215 and 657,888 can provide highly efficient thrusters capable of producing substantial thrust impulse. Modification of the structures disclosed in the Goldstein et al inventions for the thruster application is necessary because the capillary passages would become excessively hot if they were activated with the relatively high frequency required to provide the necessary thrust. In addition, there are other aspects of thruster operation, associated with efficient transfer of electric energy to plasma kinetic energy, which have no analogous counterparts in the use of plasmas to propel projectiles.

It is, accordingly, an object of the present invention to provide a new and improved plasma thruster.

Another object of the invention is to provide a new and improved highly efficient electrothermal thruster employing a capillary passage in which a plasma discharge is established.

Still another object of the invention is to provide an electrothermal thruster employing a capillary in which a plasma discharge is established and wherein the plasma discharge provides a relatively high thrust by virtue of relatively high repetition rate plasma discharges.

Still another object of the invention is to provide a new and improved plasma thruster employing a capillary passage in which plasmas are repeatedly developed at a high repetition rate and wherein a confining surface of the capillary passage is cooled.

Still another object of the invention is to provide a thruster employing a capillary passage in which a plasma discharge is repeatedly established at a high repetition rate and wherein a confining surface of the passage is cooled by a substance which adds to the momentum provided by the discharge.

A further object of the invention is to provide an electrothermal thruster employing a capillary in which a plasma discharge is established and wherein the plasma discharge provides a relatively high momentum by virtue of relatively high repetition rate plasma discharges that are converted into a quasi-continuous stream of directed mass from one end of the capillary.

DISCLOSURE OF INVENTION

In accordance with one aspect of the present invention, the thruster mounted on a mass to be propelled includes means for forming a capillary passage having a plasma confining surface. A plasma discharge is formed in the capillary passage, which is initially in either a vacuum or non-vacuum condition. The plasma discharges are either non-ablative or ablative; i.e., for an ablative discharge, material is ablated from the confining surface of the capillary passage into the capillary passage; for a non-ablative discharge, the plasma is derived from a source external to the capillary passage. The apparatus is arranged so the discharge is directed out of only one end of the capillary passage, that is open.

A supersonic equilibrium flow nozzle downstream of the open end of the passage converts high pressure plasma (typically about 1000 atmospheres) in the capillary passage into high velocity plasma having high momentum. The nozzle has a high outlet to inlet area ratio (about 100) and a Reynolds number in excess of 10, and typically about $10^7$. Without an equilibrium flow nozzle having the stated characteristics, the plasma exhaust flowing out of the open end of the capillary would be highly ionized, resulting in so-called frozen flow losses in the nozzle. The high pressure allows the ionization energy to be recovered as a directed high velocity plasma flow having a large momentum by virtue of three-body recombination collisions in the nozzle. Thus, the plasma flowing into the supersonic flow nozzle is converted by the nozzle into directed kinetic energy and relatively low ionization, dissociation and thermal energies.

Thrusters of the present invention have a very high efficiency in transferring electric energy to plasma enthalpy and in transferring plasma enthalpy to streaming velocity in the nozzle. The electric energy is transferred with high efficiency because the geometry of the capillary passage (the large length to diameter ratio of approximately 10:1) provides a relatively large ohmic resistance to an electrical pulse forming network or other source of electrical energy for supplying the plasma discharge energy; the material in the capillary passage has a resistance considerably greater than any other resistive component connected between output terminals of the pulse forming network or other electrical source. The plasma enthalpy is transferred with high efficiency to streaming velocity because the nozzle has a high area ratio and operates at high pressure and high Reynolds number to achieve nearly equilibrium, adiabatic flow. Versions of the device can operate over a very wide range of power levels, from a few watts for satellite station-keeping, or at power levels of thousands of megawatts for the launch of heavy payloads.

We have also found that a desirable quasi-steady flow of plasma from the capillary is attained by arranging the length of a discharge pulse for the plasma to be longer (preferably about ten times) than the two-way longitudinal travel time of acoustic energy in the capillary filled with the plasma. If the pulse length equals or is less than the two way longitudinal travel time, plasma is ejected in an unsteady manner from the capillary open end, reducing the velocity of fluid flowing from the capillary and inducing frozen flow losses. (A quasi-steady plasma flow has a steady flow while the pulse producing the plasma is derived; between pulse intervals the plasma flow out of the capillary drops substantially to zero.)

Liquid supplied to the capillary passage cools the passage confining surface, to prevent substantial damage thereto. The liquid is formed of a material having low atomic weight components, such as liquid hydrogen, hydrazine, or water; the liquid is divided into its atomic constituents by heat from the plasma discharge, to provide materials that flow out of the open end of the capillary passage. For the ablative structure, the atoms constituting the liquid are added to the gases ablated from the capillary passage confining surface. For the non-ablative situation, the atoms from the liquid constitute the sole source of plasma that is ejected from the open end of the passage. The injected liquid propellant is partially atomized into droplets in the capillary to assist in establishing the plasma more readily and provide greater heat transfer. Droplets of the cooling liquid are in a cooling heat exchange relation with walls of the capillary by convective heat transfer.

The propelling liquid is supplied either continuously or intermittently, at a predetermined frequency, to the capillary passage. In either case, the discharge in the capillary occurs at a time when the leading edge of the injected and partially atomized fluid is leaving the open end of the passage and entering the supersonic nozzle, immediately downstream of the open passage end. It is preferable to match the mass flow rate of the liquid to the repetition rate and energy of the plasma discharge to achieve optimum operation. If the liquid mass flow rate is too high, all of the liquid mass is not converted to heated plasma, in which case the non-heated liquid may cause the device to run at an excessively low temperature. This would reduce the velocity of gaseous atoms flowing out of the apparatus and thereby decrease the specific momentum of the structure. If the liquid mass flow rate is excessively low relative to the discharge repetition rate and energy, the opposite results are likely to occur; i.e., the capillary passage confining surface becomes excessively hot, causing a high rate of erosion therefrom and considerable erosion of an electrode at the open end of the capillary to which a high voltage is applied to establish the plasma discharge.

The above and still further objects, features and advantages of the present invention will become apparent upon consideration of the following detailed description of several specific embodiments thereof, especially when taken in conjunction with the accompanying drawings.

BRIEF DESCRIPTION OF THE DRAWINGS

FIG. 3 is a schematic diagram of a single solid propellant thruster adapted to be operated under vacuum or non-vacuum conditions in accordance with a third embodiment of the invention;

FIG. 3*a* is a waveform preferably applied by the pulse forming network of FIG. 3 to electrodes in the capillary passage of the thruster of FIG. 3;

BEST MODE FOR CARRYING OUT THE INVENTION

Figure 1:
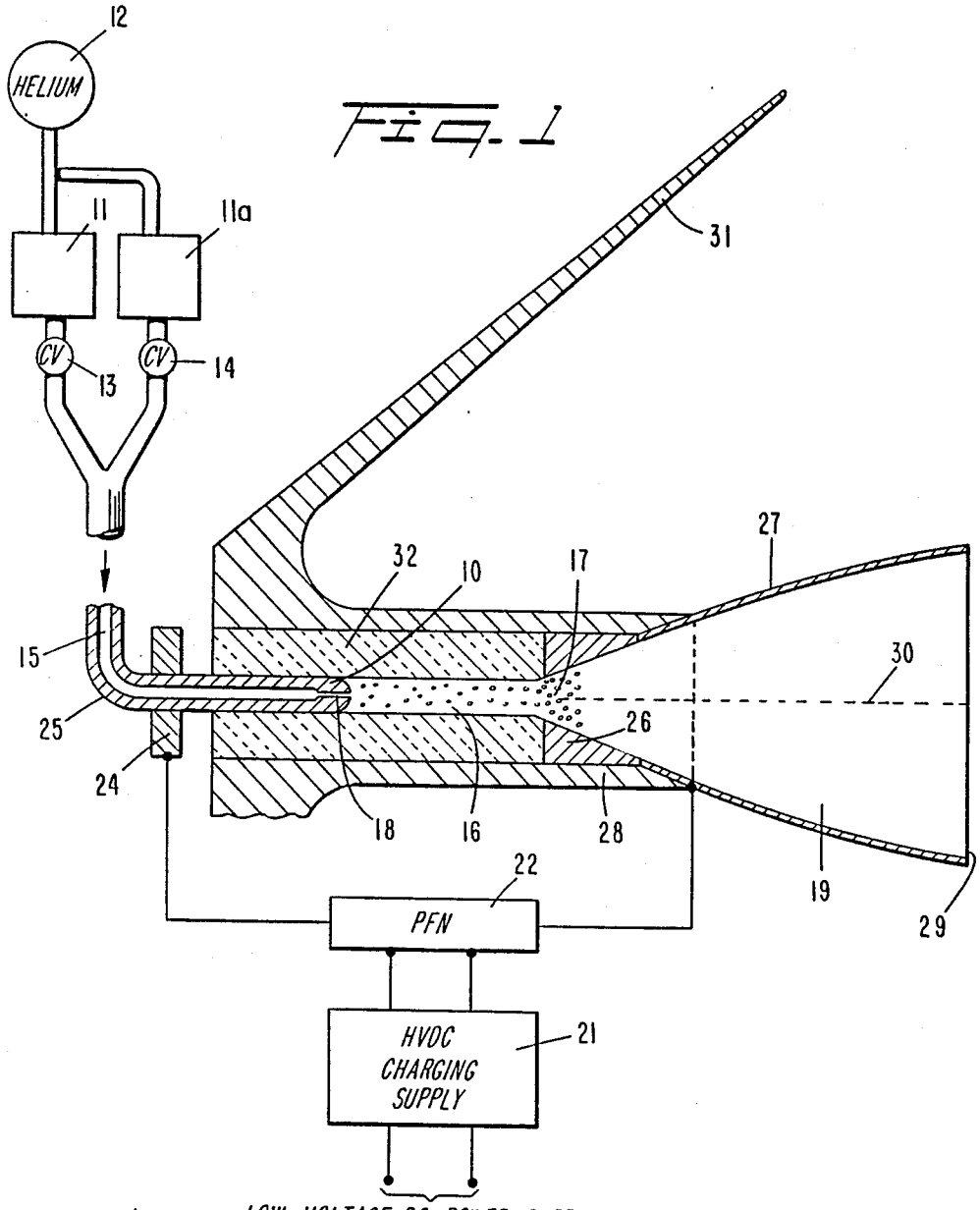
FIG. 1 is a schematic view of a single liquid propellant thruster adapted to be operated under vacuum conditions, in accordance with a first embodiment of the invention.

Reference is now made to FIG. 1 of the drawing wherein there is schematically illustrated a single thruster in accordance with one aspect of the invention. The thruster of FIG. 1 is particularly adapted to be operated in vacuum conditions, as exist in outer space. In the thruster of FIG. 1, a low atomic weight liquid propellant, such as water or monopropellant hydrazine ($N_2H_4$) or a mixture of two liquids such as water and hydrazine, or a mixture of two combustible liquids such as liquid hydrogen and liquid oxygen, is stored in tank 11, and flows via a suitable check valve 13 into conduit 15. The propellant in tank 11 is pressurized by high pressure helium in tank 12, in a manner well-known to those of ordinary skill in the art of liquid monopropellant systems.

The liquid propellant in conduit 15 flows via opening 18 in electrode 10 into capillary passage 16, preferably having a diameter to length ratio of about 1:10. Opening 18 has a relatively small diameter to provide the correct flow velocity for the liquid propellant and to reduce the back flow into passage 15 so that there is relatively low back pressure from capillary passage 16 into tank 11, whereby the flow of liquid from the tank is not impeded by the pressure in capillary 16. In capillary passage 16, the liquid propellant is partially or fully atomized and partially evaporated, so that there is a two-phase flow of liquid and gas through the capillary. The liquid propellant is dissociated into the low atomic weight elemental constituents thereof by an electric discharge that forms a plasma. In certain circumstances in which two liquids are used which do not mix in tank 11, a second tank **11*a* with valve 14 pressurized by helium in tank 12 is used, in which case the two liquids are discharged through valves 13 and 14 and mixed in conduit 15. The plasma has a very high pressure, typically about 1000 atmospheres, in capillary 16 and flows out of open end 17 of capillary 16, opposite from entry end opening 18 in electrode 10**.

The liquid, gas and plasma flow from open end 17 of capillary passage 16 into supersonic equilibrium flow nozzle 19, shaped as a cone or bell having a curved confining surface, to provide high efficiency in converting the very high pressure plasma into a directed supersonic flow having high momentum. Capillary passage 16 and nozzle 19 are aligned so they have a common longitudinal axis 30.

Ejection of low temperature plasma in thermodynamic equilibrium from nozzle 19 must occur to avoid "frozen flow" in the nozzle. Such a result is achieved by proper design of the geometry of supersonic nozzle 19 between throat region 17 and end region 29, and of the high density of the plasma. The areas of throat region 17 and exit area 29 are appropriately selected so the area ratio of region 29 to region 17 is at least 100. If the ratio is less than 100, the ejected plasma flows out of nozzle exit area 29 at high enthalpy, and an appreciable amount of the ejected plasma flows sideways out of nozzle exit area 29, so that the efficiency is decreased materially. The shape of the interior wall of flared tube 27 is displaced by 10° to 25° from the nozzle axis to achieve maximum efficiency. If the nozzle wall is displaced by more than 25° at region 29 the plasma flowing out of region 29 spreads excessively and is not adequately directed. If the angle of tube 27 is less than about 10°, there is excess length of nozzle 29 and consequently excess friction between the plasma and wall. The voltage at electrode 26 is applied as close as possible to nozzle throat 17 to provide maximum expansion of the plasma in nozzle 19. Electrode 26 is as close as possible to opening 17 so that, after electrical heating of the plasma has been completed between electrodes 26 and 10, a large area ratio exists between region 29 and electrode 26 to convert the thermal energy of the plasma into a directed momentum.

The plasma discharge is established by high voltage DC power supply 21, pulse forming network or other source 22 and electrodes 10 and 26 connected to the pulse forming network. One terminal of pulse forming network 22 is connected to an electrode assembly including metal ring 24 having an inner diameter electrically and mechanically connected to the exterior of metal tube 25 in which passage 15 is formed. Metal tube 25 extends to electrode 10 containing opening 18 through which the liquid propellant flows into capillary 16. The other terminal of pulse forming network 22 is connected to metal flared tube 27 that forms the end of nozzle 19, i.e., the portion of the nozzle extending between throat region 17 and the nozzle end 29. Flared tube 27 is connected to electrode 26 and to metal compression jacket 28, preferably formed of high temperature stainless steel which contains and compresses insulator 32. The interior of flared tube 27 and of jacket 28 between opening 17 and exit region 29 forms a continuous bell-shaped or conical surface of revolution about longitudinal axis 30 of passage 16. The portion of passage 15 that exits into opening 18 has a longitudinal axis coincident with axis 30. Opening 18 may also be formed of a number of small holes arranged symmetrically around axis 30.

Jacket 28 surrounds and squeezes high temperature ceramic dielectric tube 32 having a central longitudinal bore into which tube 25 is fitted and which defines passage 16. Jacket 28 squeezes tube 32 so the tube is always in compression under all operating conditions of the thruster, to prevent cracking of tube 32. The central bore at the end of tube 32, where opening 17 is located, is slightly flared outwardly to match the continuous shape of the nozzle formed by flared tube segment 27 and electrode 26. The material chosen for ceramic tube 32 must have a relatively high thermal conductivity to provide heat conduction from capillary passage 16 to compression jacket 28, to enable passage 16 to remain relatively cool during operation. In other words, tube 32 must be capable of transferring the heat supplied to the walls of passage 16 by the plasma in the passage to jacket 28, for removal to the outer space environment in which the thruster is operating.

The heat transferred by high temperature ceramic insulator 32 to compression jacket 28 is transferred to the environment surrounding the thruster by providing the portion of the jacket remote from nozzle 19 with an elongated metal fin 31 that extends radially from the remainder of the thruster, in a direction toward nozzle 19. Metal fin 31 is an integral portion of jacket 28 to transfer heat conducted to it through ceramic insulator tube 32 to space. Fin 31 is oriented so as to radiate a minimum amount of energy back to the spacecraft to which the thruster is attached.

Tube 32 is formed of any well-known high temperature ceramic, such as various forms of silicon nitride, alumina, and silicon carbide. A high temperature ceramic insulator is preferably employed for tube 32 for non-ablative uses of the thruster. For some applications, insulator 32 is preferably an ablative material, as described infra in connection with FIG. 3.

In operation, liquid from tank 11 or tanks 11 and 11*a* continuously flows into passage 15 and the high voltage DC charging supply 21 is activated to charge pulse forming network 22 at a predetermined frequency, such as 200 pulses per second. The charging voltage of 2000 V to 8000 V supplied by network 22 causes a discharge to be established in capillary passage 16 between electrodes 10 and 26 at a time when partially atomized fluid is entering supersonic nozzle 19 through opening 17. The velocity and mass flow rate of liquid flowing through passage 16 and the repetition rate and energy of the plasma discharge between electrodes 10 and 26 are matched to achieve optimum operation. If the liquid velocity and mass flow rate were excessively low with regard to the rate at which pulses are applied between electrodes 10 and 26 and with regard to the energy of the pulses, the liquid mass would be heated to excessively high temperatures in passage 16, resulting in ablation of electrodes 10 and 26 and of insulator 32. Alternatively, if the liquid mass flow rate and velocity were excessively high relative to the rate and energy of pulses which are applied between electrodes 10 and 26 the vapor flowing out of opening 17 into nozzle 19 would be excessively cool and have a relatively low velocity, which decreases the efficiency of the thruster.

In operation, propellant from tank 11 or tanks 11 and 11*a* flows continuously through needle check valve 13 or valves 13 and 14 into passage 15. Typically opening 18 at the end of passage 15 has an inner diameter of approximately 0.3 millimeters and is 1 centimeter long. Propellant flowing out of opening 18 partially atomizes into drops. The propellant flows through opening 18 into capillary passage 16, typically having a length of about 5 centimeters and a diameter of about half a centimeter. The water in passage 16 cools the passage, as well as a portion of the walls of nozzle 19.

Figure 1A:
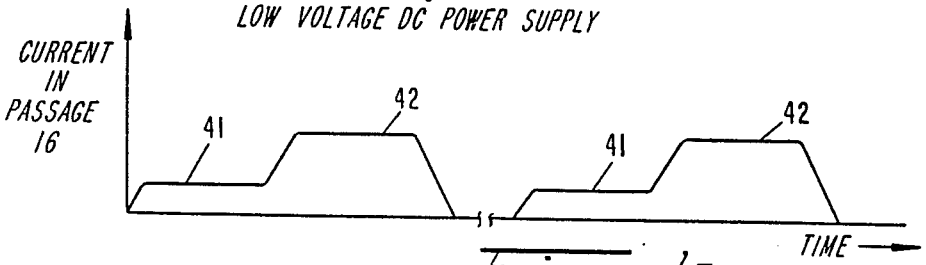
FIG. 1*a* is a waveform preferably applied by the pulse forming network of FIG. 1 to electrodes longitudinally spaced from each other along the length of a capillary in the FIG. 1 thruster.

In the preferred embodiment, pulse forming network 22, which can be of conventional design, initially applies a relatively low energy pulse between electrodes 10 and 26, as indicated by waveform portion 41, FIG. 1*a*. The current flowing in passage 16 during waveform portion 41 causes all of the propellant in the capillary passage to be evaporated, producing a quasi-uniform temperature of the propellant in capillary passage 16. Current flows uniformly through capillary passage 16 between electrodes 10 and 26. The duration of waveform portion 41 is kept short to minimize propellant flow out of the capillary while portion 41 is derived.

When waveform portion 41 has been completed, the current supplied by pulse forming network 22 between electrodes 10 and 26 increases to approximately 10–30 kiloamperes, as indicated by waveform portion 42 which is continuous with and follows immediately after waveform portion 41. The increased current in capillary passage 16 between electrodes 10 and 26 causes the propellant in the capillary to be converted into an ionized, high pressure plasma. The plasma flows through opening 17 into supersonic nozzle 19. Nozzle 19 converts the high pressure of the plasma flowing in capillary 16 through opening 17 into a high velocity, high momentum flow having a directed velocity along axis 30 away from nozzle end 29.

While the plasma is established in passage 16 during wave portions 41 and 42, the resistance between electrodes 10 and 26 drops rapidly from virtually an open circuit condition along the length of dielectric tube 32 to about 100 milliohms, roughly matching the characteristic impedance of pulse forming network 22 to provide maximum power transfer between the pulse forming network and the discharge in capillary passage 16. Propellant droplets in passage 16 are evaporated by radiation from the plasma and by convective heat transfer from the plasma, a condition which establishes the energy requirement for pulse waveform portion 41. Waveform portion 42 typically has a duration of a few tens of microseconds, while waveform portion 41 typically has a length anywhere between one-third that of waveform portion 42 and three times the length of waveform portion 42. The length of waveform portion 41 is determined by the flow velocity of the liquid in passage 16, the time required to convert virtually all of the water droplets in passage 16 into a vapor state, and the length of passage 16. The length of waveform portion 42, i.e., the duration of the high current portion of the plasma discharge, is greater than the two way travel time of acoustic energy in the plasma in capillary passage 16 between ends 17 and 18 of the passage to provide for the quasi-steady flow of the plasma from end 29 of nozzle 19.

It is not necessary, in a vacuum atmosphere, to provide a trigger circuit to initiate the discharge in capillary passage 16. Instead, Paschen breakdown occurs through the vapor surrounding the injected liquid propellant in passage 16 at the initiation of pulse 41 to cause the propellant to be converted into a plasma. The propellant must therefore possess a sufficiently high vapor pressure to permit Paschen breakdown in this mode of operation.

Figure 2:
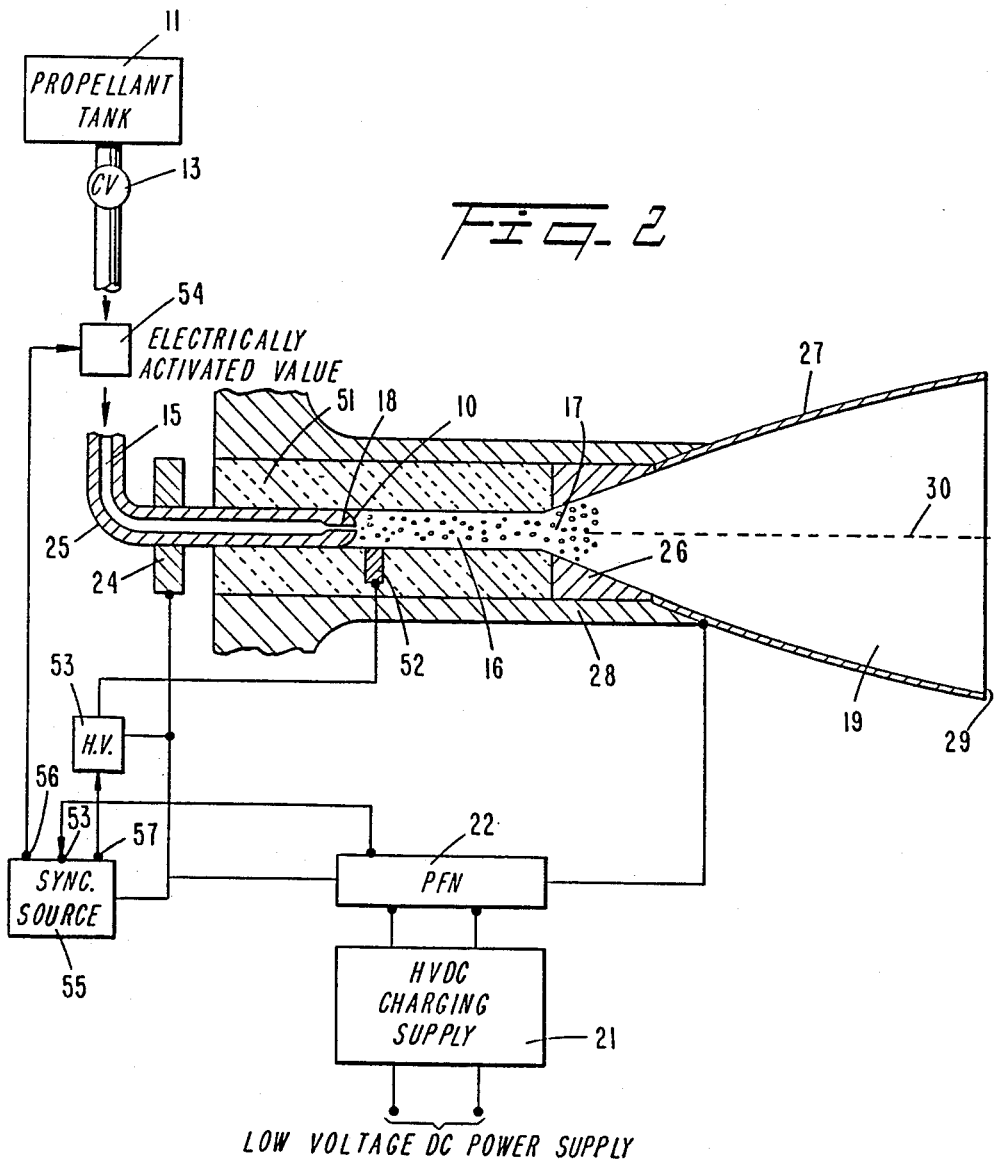
FIG. 2 is a schematic diagram of a single liquid propellant thruster adapted to be operated in non-vacuum conditions in accordance with a second embodiment of the invention.

In accordance with a second embodiment of the invention, as illustrated in FIG. 2, the thruster is designed to be operated under non-vacuum conditions. With a non-vacuum system, it is necessary to provide an auxiliary source for establishing the discharge in capillary passage 16. In the illustrated embodiment, the auxiliary discharge is provided by spark plug 52, mounted in the wall of passage 16, immediately downstream of opening 18. Spark plug 52 is connected to a high voltage source 53 which initiates an electric discharge between an electrode (not shown) in spark plug 52 and electrode 10.

The electrode of spark plug 52 is exposed to the gases in capillary passage 16 to enable the discharge to be established between the electrode of plug 52 and electrode 10.

It is also frequently desired for non-vacuum environments, as well as in some outer space situations, to supply liquid to passage 15 on a pulsed, rather than continuous basis. To this end, electrically operated valve 54 is connected between passage 15 and check valve 13 to control the flow of propellant from source 11 into passage 15.

To control the relative timing of the opening of valve 54, the initiation of a discharge in capillary passage 16 between electrode 10 and spark plug 52, and the application of a power pulse from network 22 to the capillary passage between openings 17 and 18, synchronizing source 55 is provided. Synchronizing source 55 includes two output terminals 56 and 57 respectively connected to valve 54 and high voltage source 53 and one input terminal connected to pulse forming network 22. Source 55, when triggered by a signal supplied by network 22 to input terminal 58, supplies pulses to each of terminals 56 and 57 at the same frequency, but with different phases to provide proper operation of the thruster, in a manner similar to that described supra in connection with FIG. 1.

When the voltage in network 22 has reached a predetermined level, a trigger pulse is sent to terminal 58 to trigger source 55. The pulse supplied by source 55 to terminal 56 causes valve 54 to open, causing propellant to be supplied from source 11 to passage 15. Source 55 also supplies a pulse to terminal 57 at the time propellant droplets flowing from passage 15 into capillary 16 have filled capillary 16, causing high voltage source 53 to apply a voltage between the electrode of plug 52 and electrode 10, creating an electrically conducting plasma. The availability of a conducting plasma in passage 16 causes pulse forming network 22 to derive a current having the shape indicated by the waveform of FIG. 1*a*. Alternatively, pulse forming network 22 is designed so the low current portion of the waveform 41 is not included in the pulse supplied between electrodes 10 and 26, so that only high current pulse portion 42 is generated by pulse forming network 22 in capillary passage 16. In either case, the water droplets in passage 16 are vaporized and heated to high pressure and temperature when high current portion 42 begins to flow in passage 16 between electrodes 10 and 26.

In a vacuum environment where Paschen breakdown through the propellant vapor can occur between electrodes 10 and 26, spark plug 52 and high voltage source 53 can be eliminated, and synchronizing source 55 derives a signal to command opening of valve 54 upon receiving a trigger signal from network 22.

In accordance with a third embodiment of the invention, as illustrated in FIG. 3, the thruster is designed to be operated with a solid propellant. In this situation, non-ablative ceramic insulator 32 is replaced with ablative insulator tube 51 made of materials which, when ablated to form a plasma by a discharge in passage 16, have low atomic weight. In one preferred embodiment, insulator tube 51 is made of polyethylene that is ablated into the low atomic weight gases of hydrogen and carbon. In such an instance, the need for a propellant supply tank and associated check valve is obviated. Ablative tube 51 can also be used in space applications, but has no means of replacing the propellant consumed by the structure as is done with the structure of FIGS. 1 and 2.

In the embodiment of FIG. 3, high voltage DC charging supply 21 raises the voltage of network 22 until an electrical breakdown occurs in a thin carbon layer (not shown) on the inner wall of tube 51, between electrodes 10 and 26. Initially, prior to the first discharge the carbon layer is provided by graphite particles lying on the inner wall of the capillary passage. In response to each discharge between electrodes 10 and 16, carbon particles from the polyethylene in tube 51 forms a carbon layer on the inner wall of the tube. The carbon layer provides a relatively low impedance path between electrodes 10 and 16 to enable the discharge to be initiated between the electrodes. Network 22 generates a high current pulse 42 as shown in the waveform of FIG. 3*a*. The low current portion (41 in FIG. 1) is not used with ablative wall systems, as illustrated in FIG. 3.

In response to the high voltage discharge established in capillary 16 during the high current portion of the pulse 42 derived by network 22, hydrogen and carbon are ablated from the wall of tube 51 that forms passage 16. The ablated material in passage 16 forms a plasma that is ejected through opening 17 into nozzle 19. The resulting plasma flows out of nozzle 19 as directed momentum that applies a thrust to a vehicle on which the thruster is located.

If desired, a spark plug 52, high voltage source 53 and sync source with terminals 57 and 58 as shown in FIG. 2 can be used to provide precise timing, if the trigger signal supplied to terminal 58 is provided by a precision timing clock circuit (not shown).

Figure 4:
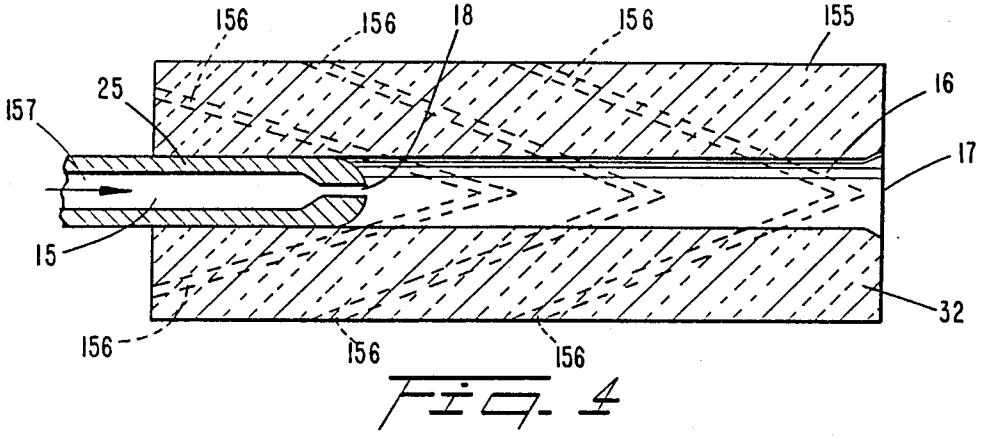
FIG. 4 is a schematic diagram of a modified version of a ceramic insulator adapted to be used in the thruster of FIG. 1.
Figure 5:
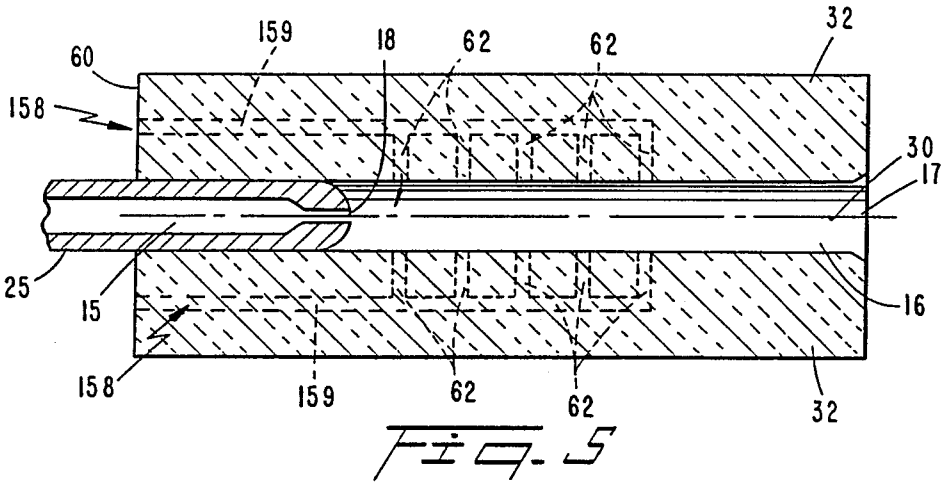
FIG. 5 is a schematic diagram of a further modification of a portion of the thruster of FIG. 1.

In the embodiments of FIGS. 1 and 2, the walls of passage 16 are cooled by injecting water droplets axially of the passage 15 and opening 18. Other structures can be provided for water to cool the wall of passage 16, e.g., as illustrated in FIGS. 4 and 5. In the embodiment of FIG. 4, the solid ceramic insulator tube 32 of FIG. 1 is replaced with a ceramic insulator tube 155 having passages 156 which are longitudinally and radially directed so they have spaced openings at different longitudinal and radial positions into passage 16 between openings 17 and 18. The ends of passages 156 along the exterior walls and face of tube 32 are connected to a pressurized propellant supply (not shown in FIG. 4) which supplies propellant droplets to passages 156; the droplets flow out of passages 156 to form a liquid film on passage 16. The liquid film on passage 16 is vaporized in the manner discussed supra with regard to vaporization of propellant from source 11 in passage 16.

As indicated by arrow 157, tube 25 can be inserted by differing amounts into passage 16. Thereby, as the tip of tube 25 adjacent opening 18 erodes in response to the discharge between opening 17 and 18, tube 25 is inserted into passage 16 by differing amounts, to maintain the separation between openings 17 and 18 constant.

In another embodiment, illustrated in FIG. 5, the propellant film on the wall of passage 16 is provided by water flowing through a series of passages 158. Each of passages 158 includes a longitudinal portion 159 that terminates in end face 60 of tube 32 opposite from the end face containing opening 17. Propellant is supplied under pressure from a suitable source (not shown in FIG. 5) to passage portions 159. Each of passages 158 includes plural radially extending portions 62 leading from longitudinal passage portions 159 into the wall of capillary passage 16, at spaced longitudinal positions along the capillary passage. Propellant flowing from passage portions 159 into passage portions 62 forms a film on the inner wall of capillary passage 16. Alternatively, propellant droplets from passage portions 62 flow radially in capillary passage 16 toward axis 30 to encircle the propellant supplied to passage 16 via passage 15 and opening 18. In either event, the propellant in passage 16 encircles the propellant flowing through opening 18 into capillary passage 16 to cool ceramic insulator tube 32.

Figure 6:
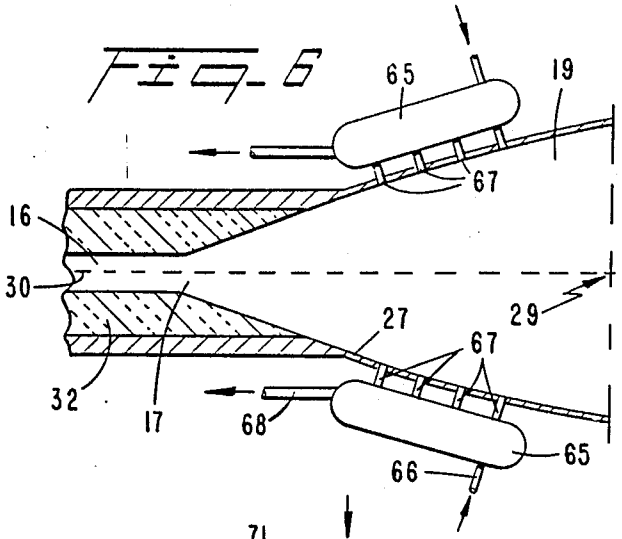
FIG. 6 is a further modification of the thruster of FIGS. 1 and 2 wherein there is transpiration cooling of a supersonic nozzle downstream of a capillary.

Cooling can also be provided to nozzle 19 downstream of opening 17, between opening 17 and end region 29, by a mechanism similar to transpiration cooling, as illustrated in FIG. 6. In the embodiment of FIG. 6, the pressurized liquid propellant supplied to opening 18 (FIG. 1) serves as a cooling medium for flared tube 27 downstream of opening 17. The liquid propellant from tank 12, prior to flowing through opening 18, is heated by contact with flared tube 27, which is heated by the plasma ejected from opening 17. The heat exchange between the plasma in nozzle 19 and the propellant raises the temperature of the propellant entering passage 15 and opening 18. This provides higher efficiency because the liquid propellant is regeneratively heated by the discharge of the plasma which it forms.

In the nozzle cooling structure illustrated in FIG. 6, plural manifolds 65 are located adjacent flared tube 27 between opening 17 and end region 29. While only two such manifolds 65 are illustrated in FIG. 6, it is to be understood that more than two equally spaced manifolds are provided at different angular positions relative to axis 30, when looking through a cross-section of jacket 29 transverse to axis 30. Manifold 65 is connected to inlet passage 66, in turn connected to pressurized liquid propellant source 12 (not shown in FIG. 6). The pressurized liquid propellant flowing from passage 66 into manifold 65 flows radially through passages 67, between manifold 65 and the wall of tube 27 between opening 17 and end region 29. The pressurized liquid propellant thus cools the portion of the wall of tube 27 exposed to the hot plasma flowing out of opening 17, between opening 17 and end region 29. Because of the heat transfer between the plasma and the pressurized propellant liquid in manifold 65, the pressurized propellant liquid is heated. The pressurized liquid propellant flows out of manifold 65 into passage 68, thence to passage 15 in tube 25. The thus heated pressurized liquid propellant flows from passage 15 through opening 18 and is converted into a plasma by the discharge established between openings 17 and 18 by the high voltage from pulse forming network 22. High temperature ceramic insulator 32 is cooled in the manner described supra in connection with any of FIGS. 1, 2, 4 or 5.

Figure 7:
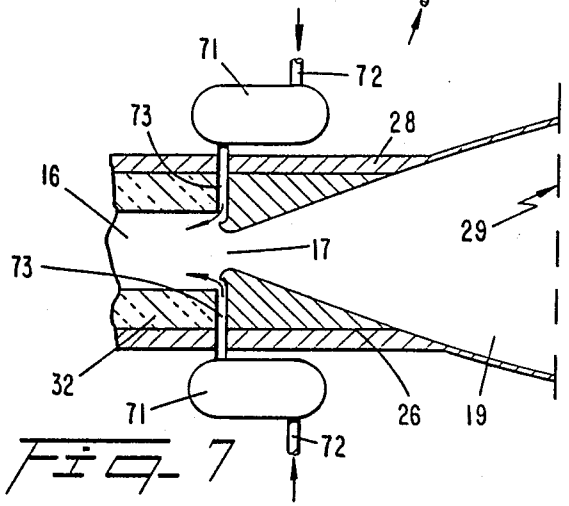
FIG. 7 is a schematic diagram of another modification of the invention wherein water is injected into the capillary immediately upstream of an open end thereof which enters into the nozzle.

An alternative structure for cooling the wall portion of nozzle 19 between opening 18 and end region 29 is illustrated in FIG. 7 wherein high pressure propellant is injected into smoothing tank 71 by way of passage 72. From smoothing tank 71, the propellant flows through passage 73 into the end of capillary passage 16 in the vicinity of opening 17, i.e., at the end of passage 16 where nozzle 19 begins. Passage 73 has an opening facing away from opening 17, toward opening 18. Propellant flowing from passage 73 has a tendency to flow axially into capillary passage 16 against the direction of plasma flow through passage 16 into nozzle 19. However the high pressure, about 1000 atmospheres, plasma in capillary 16 sweeps the propellant into nozzle 19 to cool the portion of the nozzle wall between opening 17 and end region 29. Smoothing tank 71, as well as passages 72 and 73, are formed in compression jacket 28 adjacent opening 17. Passage 73 is formed as a space between the end face of tube 32 and jacket 28. Alternatively, passage 73 can be formed exclusively in jacket 28 and electrode 26 with an axially directed opening.

Figure 9:
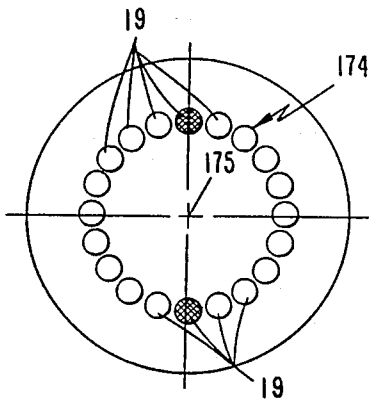
FIG. 9 is an end view of the thruster array illustrated in FIG. 8.
Figure 8:
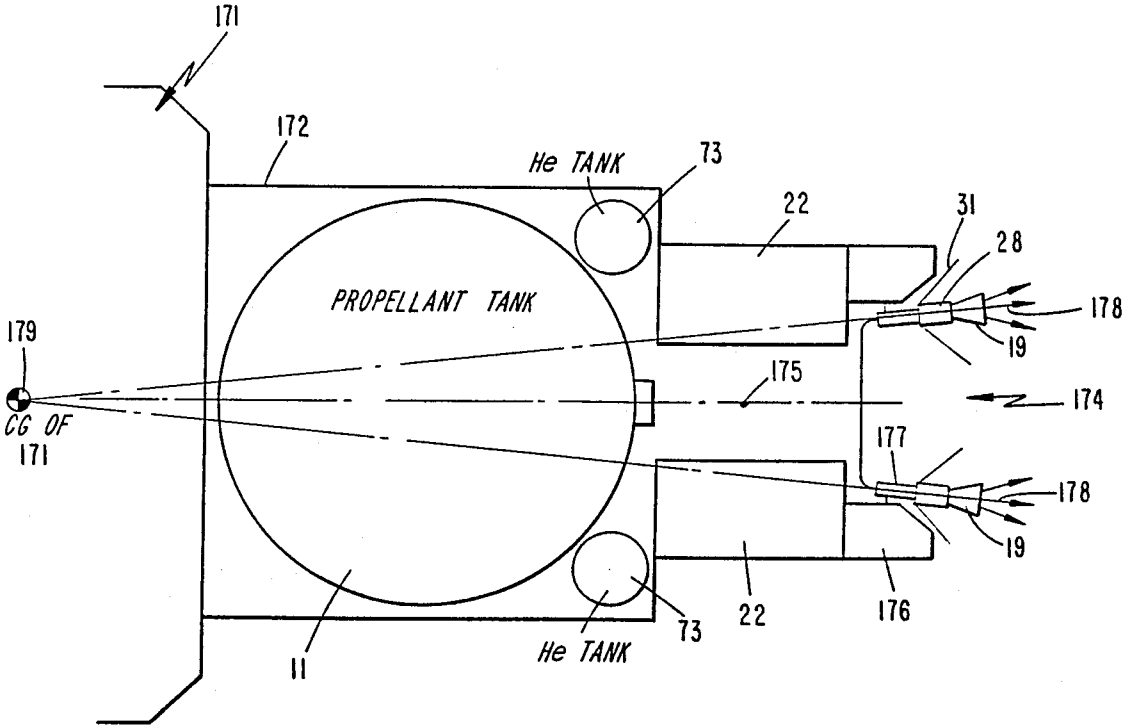
FIG. 8 is a side schematic view of an array of plural thrusters of the type illustrated in FIG. 1.

Reference is now made to FIGS. 8 and 9 where spacecraft 171 is illustrated as including an array of thrusters of the type described supra in connection with FIGS. 1 or 2. Space craft 171 includes an aft end housing 172 where propellant tank 11 and tank **11*a* (not shown in FIGS. 8 and 9**) are located.

Mounted on aft end housing 172, remote from the remainder of space craft 171, is thruster array 174; each thruster in array 174 is of the type described in connection with FIGS. 1–7. The thrusters of array 174 are symmetrically arranged in a circle about space craft axis 175 so that each of the thrusters is equi-spaced in a radial direction from axis 175; adjacent thrusters are spaced from each other by equal angles. Each thruster has a longitudinal axis 178 tilted with respect to axis 175 so as to pass through the spacecraft center of gravity 179. In the embodiments illustrated in FIGS. 8 and 9, twenty such thrusters are provided. The thrusters of array 174 are mechanically connected by suitable conduits (not shown) to tanks 11 and **11*a* and are electrically connected to pulse forming networks 22, mounted in housing 172. One pulse forming network is provided for all of the thrusters in array 174. Suitable switching circuits are provided between the pulse forming network and the thrusters of array 174** so diametrically opposed thrusters are simultaneously activated in pairs.

The thrusters of array 174 are mechanically connected to housing 176 that carries switches which connect each thruster to pulse forming network 22. High voltage insulating sleeve 177 extends from fin 31 and jacket 28 of each of the thrusters in array 174. Suitable electric and liquid lines extending through insulator jackets 177 provide the necessary fluid and electric connections to capillary passage 16. Insulator jackets 177 are suitably mounted by struts (not shown) on housing 176 for the switches in the housing.

While there have been described and illustrated several specific embodiments of the invention, it will be clear that variations in the details of the embodiments specifically illustrated and described may be made without departing from the true spirit and scope of the invention as defined in the appended claims.

We claim:

1. An electrothermal thruster adapted to be mounted on a mass to be propelled comprising means for forming a capillary passage having an elongated plasma confining surface that is an outer boundary for plasma in the passage, the passage having an open end, electric means for forming a plasma discharge in the capillary passage, the capillary passage being arranged so that the plasma is ejected from the capillary passage only out of the open end, the ejected plasma being a thrust source for the mass, the plasma in the capillary passage having a very high pressure on the order of 1000 atmospheres, the capillary being constructed so plasma flowing out of the open end has a tendency to be highly ionized and dissociated, and a supersonic, equilibrium flow nozzle having an inlet positioned to be responsive to the plasma ejected from the open end, the nozzle having a high outlet to inlet area ratio and a high Reynolds number for achieving substantially adiabatic and equilibrium directed kinetic energy and relatively low ionization, dissociation and thermal energies.

2. The apparatus of claim 1 wherein the ratio is at least 100:1.

3. The apparatus of claim 1 wherein the surface is a dielectric, the plasma forming means including a pair of electrodes longitudinally spaced by the dielectric from each other along the length of the passage.

4. The apparatus of claim 3 wherein the dielectric is an ablatable solid having low atomic weight elements that are dissociated into the plasma in response to the plasma discharge.

5. An electrothermal thrust adapted to be mounted on a mass to be propelled comprising means for forming a capillary passage having an elongated plasma confining surface that is an outer boundary for plasma in the passage, the passage having an open end, means for forming a plasma discharge in the capillary passage, the capillary passaging being arranged so that the plasma is ejected from the capillary passage only out of the open end, the ejected plasma being the thrust source for the mass, the passage having a second end opposite from the open end, the means for forming the plasma discharge including electrode means for establishing the discharge longitudinally of the capillary passage between the inlet and the open end, and means for intermittently establishing the discharge for an interval that is at least equal to the two way travel time of the acoustic energy in plasma in the capillary passage between the second and open ends.

6. The apparatus of claim 5 further including a supersonic nozzle immediately downstream of the open end for converting high pressure plasma flowing out of the open end into a directed high momentum plasma.

7. The apparatus of claim 5 wherein the surface is a dielectric, the electrode means including a pair of electrodes longitudinally spaced by the dielectric form each other along the length of the passage.

8. The apparatus of claim 7 further including a source of liquid propellant connected to the means for causing the atomized liquid to flow so that the atomized liquid propellant comprises the plasma source.

9. A method of operating an electrothermal thruster including a capillary passage having an elongated plasma confining surface that is an outer boundary for the plasma in the passage, the passage having an open end and a second end opposite from the open end, comprising electrically forming a plasma discharge longitudinally in the capillary passage between the open and second ends, the plasma discharge causing plasma to be formed in the passage and to be ejected only out of the open end of the capillary passage, the ejected plasma being a thrust source for a mass accelerated by the operating thruster, the discharge being intermittently formed for an interval that is at least equal to the two way travel time of acoustic energy in plasma in the capillary passage between the second and open ends.

* * * * *